US005979887A

United States Patent [19]

Hassman

[11] Patent Number: 5,979,887

[45] Date of Patent: Nov. 9, 1999

[54] APPARATUS FOR INSTALLING SHEET MATERIAL OVER AN EXISTING CEILING

[76] Inventor: Dean P. Hassman, 2075 Forest, Denver, Colo. 80207

[21] Appl. No.: 08/818,347

[22] Filed: Mar. 15, 1997

[51] Int. Cl.[6] ..... B25B 1/20

[52] U.S. Cl. ..... 269/40; 269/43; 269/904

[58] Field of Search ..... 33/647; 414/11; 269/43, 904, 40, 71

[56] References Cited

U.S. PATENT DOCUMENTS

| | | | |
|---|---|---|---|
| 3,910,421 | 10/1975 | Panneton . | |
| 4,027,802 | 6/1977 | Reynolds | 414/11 |
| 4,208,799 | 6/1980 | Frantello | 33/647 |
| 4,314,429 | 2/1982 | Casteel et al. | 52/127 |
| 4,600,348 | 7/1986 | Pettit . | |
| 4,867,403 | 9/1989 | Anderson . | |
| 4,889,459 | 12/1989 | Anderson . | |
| 5,129,774 | 7/1992 | Balseiro . | |
| 5,163,799 | 11/1992 | Lynn . | |
| 5,274,978 | 1/1994 | Perkonigg et al. | 269/904 |
| 5,322,403 | 6/1994 | Herde . | |
| 5,407,183 | 4/1995 | Singeltary . | |
| 5,408,757 | 4/1995 | Lenz | 33/647 |

*Primary Examiner*—Robert C. Watson
*Attorney, Agent, or Firm*—Thomas W. Hanson

[57] ABSTRACT

A device for installing drywall or other sheet materials on a ceiling where access to the joists is limited by an existing ceiling or vapor barrier. The device aligns with the leading edge of an installed sheet, braces against the floor, and provides a support ledge for the trailing edge of a new sheet as it is installed. A clearance gap in the device allows it to be removed while leaving a flush seam between the two sheets. The same device serves to support the leading edge of the new sheet as it is raised into position.

9 Claims, 16 Drawing Sheets

APPARATUS FOR INSTALLING SHEET MATERIAL OVER AN EXISTING CEILING

RELATED APPLICATIONS

The disclosed invention is in the same art field as applicant's co-pending application Ser. No. 08/713,614 filed Sep. 13, 1996 now abandoned but is not otherwise related.

1. Field of the Invention

This invention relates to the handling of sheet goods used in the construction of buildings and in particular to supporting such sheets in position for attachment to a ceiling.

2. Background of the Invention

In current building methods, it is common to use a variety of sheet goods as facing material in constructing walls and ceilings. Plywood may be used on exterior walls or where strength is needed, drywall is used on interior walls where a smooth finish is desired. These sheet goods are available in a variety of sized, including 4 feet by 8 feet and 4 feet by 12 feet. This size combines with the significant weight of the sheets to result in a sheet which is difficult to handle. This difficulty increases where the sheets are to be installed in an overhead location, such as for a ceiling.

A typical method of installing these sheet goods is for one person to hold the sheet in place while a second person attaches the sheet to the underlying joists or studs with nails or screws. For large overhead sheets, more than two people may be required. When installing drywall, accurate placement of the sheet is required to minimize the gap between the sheets. Excessive gaps will be difficult to fill, reducing the quality of the finished surface.

A variety of mechanisms have been developed to assist in the placement and support of sheet goods. Some are intended only to support the sheet after it has been placed in position while other mechanisms also assist in lifting or positioning the sheet. In some cases, the mechanism attaches to the joists or studs and in others, it is supported by the floor. U.S. Pat. No. 5,163,799 to Lynn discloses an example of the prior approach while U.S. Pat. No. 5,322,403 to Herde discloses an example of the latter. The mechanism of U.S. Pat. No. 3,910,421 is a hybrid approach which is supported by the floor, and stabilized by the joists. These mechanisms are typically large, cumbersome to use, and expensive.

More compact apparatus have also been developed. U.S. Pat. No. 4,867,403 to Anderson discloses a support which screws into the joist between the drywall sheets. As disclosed in the patent, this type of design approach suffers from bending or breaking of the screw shaft during use. To reduce this problem a relatively large screw shaft must be used. This results in a significant gap between the sheets which increases the difficulty of finishing the resulting seam. U.S. Pat. No. 5,407,183 to Singeltary discloses a tool which attaches directly to a previously installed sheet. This eliminates the gapping problem of Anderson but introduces the problem of blemishes in the installed sheets caused by the screws or nails used to attach the tool.

Many of the above approaches are relatively slow to use. For some, the apparatus is cumbersome and slow to move. Others require re-attachment of the apparatus at a new location for each sheet. Still others set up quickly but are slow in operation, such as those using a hand-crank mechanism to operate.

Many of the existing mechanisms require access to the ceiling joists to attach the mechanism. The Anderson patent, above, screws into the joists while the Lynn patent, above, hooks over the top of the joists. Where a new ceiling is being installed over an existing ceiling, these approaches become unusable, or impractical, because the joists are inaccessible.

There is a need in the art for a simple, lightweight, inexpensive apparatus which will allow one person to install sheet material in an overhead position over an existing ceiling. There is a need for such an apparatus which can be used quickly, leaves no gap between the sheets, and does not mar the installed sheets.

SUMMARY OF THE INVENTION

The present invention is directed to an apparatus for positioning and supporting sheet material during installation on a ceiling. The apparatus comprises a main body formed to provide an alignment ledge for the leading edge of an existing sheet, a support ledge for the trailing edge of a new sheet, a clearance gap for the trailing edge of the new sheet, and a support leg. The alignment ledge may be either L-shaped or simplicity or C-shaped enclose the edge of the sheet on three sides. The apparatus may additionally be provided with a curved support ledge to allow the new sheet to be slid over the edge of the ledge without marring the sheet; a stabilizing ledge to prevent the rotation of the about the edge of the sheet; and a pivot between the leg and the body of the apparatus.

In a further embodiment of the invention, the support ledge may be lengthened and formed at an angle which allows it to be placed flush the surface of a new sheet, adjacent to an existing wall, without the body of the apparatus contacting the sheet. A locking pin may be fitted to hold the body of the apparatus in position relative to the leg.

In a still further embodiment of the invention, the alignment ledge and clearance gap may be deepened and the support leg and stabilizing ledge eliminated. The weight of the apparatus and the new sheet is borne entirely by the installed sheet.

In a still further embodiment of the invention, the support ledge can be eliminated and the alignment ledge deepened and a spacer used to prevent the edge of the installed sheet from fully entering the alignment ledge. The trailing edge of the new sheet is placed directly into the clearance gap and raised into position. For removal, the spacer is removed, the apparatus shifted so that the leading edge of the installed sheet fully enters the alignment ledge, and the trailing edge of the new sheet disengaged the clearance gap.

In all embodiments of the invention, the apparatus is sufficiently compact and lightweight that it may be easily manipulated by a single person and requires no access to the ceiling joists.

DESCRIPTION OF THE PREFERRED EMBODIMENT

Figure 1:
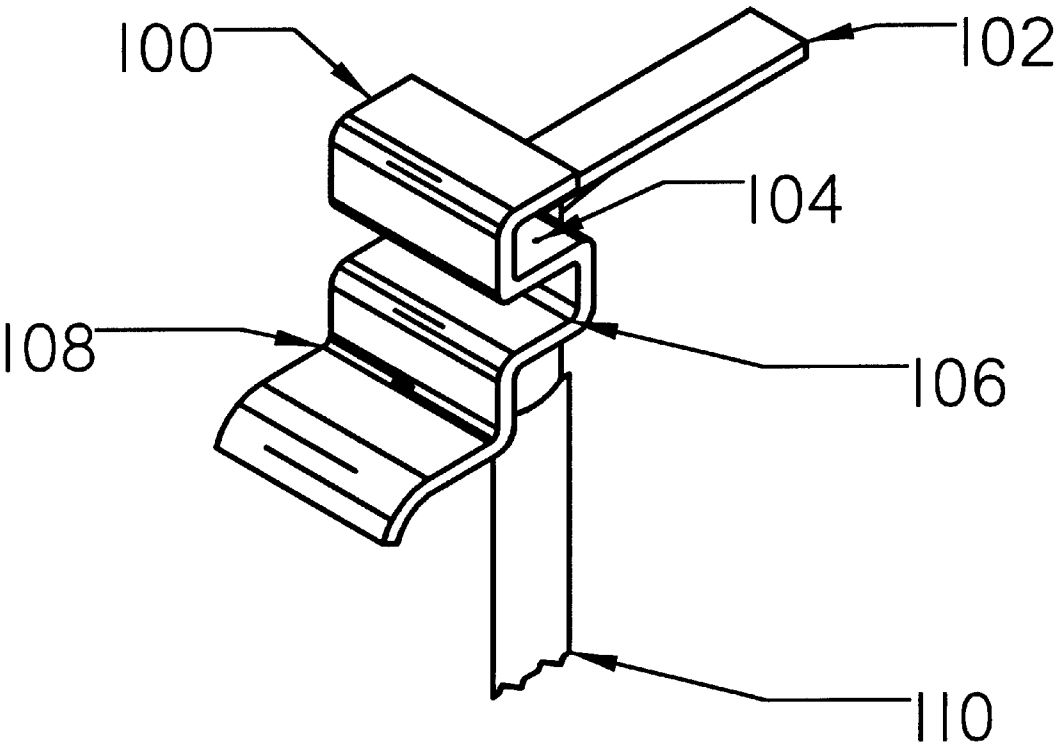
FIG. 1 is a perspective view of a first embodiment of the disclosed apparatus.

The following description is of the best presently contemplated modes of carrying out the present invention. This description is not to be taken in a limiting sense but is made merely for the purpose of describing the general principles of the invention. The scope of the invention should be determined by referencing the appended claims.

The device of the present invention is generally applicable to the installation of sheet goods in an overhead position as for a ceiling. It may be used in a conventional installation where drywall is being attached to open joists. However, the apparatus is of greatest benefit when used to install new sheet goods, such as drywall, over an existing ceiling which prevents access to the joists. It is of similar benefit when a vapor barrier has been installed on the lower surface of the joists, again preventing access to the joists for use in supporting an installation tool. For simplicity, the following description of the invention will discuss only the application of the device to installing sheet goods over an existing ceiling. This is not to be taken as a limitation of the device but merely as an illustration of one mode of use.

The following is a brief glossary of terms used herein. The supplied definitions are applicable throughout this specification and the claims unless the term is clearly used in another manner.

Alignment Ledge—in reference to the disclosed invention this describes a generally C-shaped opening which receives the leading edge of a drywall sheet. In some embodiments the alignment ledge may be L-shaped rather than C-shaped.

Body—as used in reference to the disclosed invention, this describes that portion which pivots relative to the leg and generally comprises the alignment ledge, clearance gap, support ledge, stabilizing ledge and related structural components.

Clearance Gap—when used in reference to the disclosed invention this term describes a generally C-shaped opening sized to receive the trailing edge of a drywall sheet allowing the apparatus to be moved in the direction of the center of the sheet.

Drywall—in it's most narrow sense, this describes a sheet product composed of gypsum with a paper surface sheet. The present invention is most often used with drywall in this sense and will be described herein for that use. However, the present invention is equally applicable to all types of sheet goods used in construction such as plywood and acoustic paneling. It is understood that where drywall is specifically referenced, other types of sheet goods may also be used.

Leading Edge and Trailing Edge—as used in reference to a sheet of drywall which is being installed, the trailing edge is closest to the adjacent, previously installed sheet and the leading edge is opposite. Work generally progresses in the direction of the leading edge as new sheets are installed.

Leg—in reference to the disclosed invention, this describes an elongated support member which extends from the apparatus, in position holding a sheet against the ceiling, to the floor, or other surface, to provide support for the sheet. The leg may be of various lengths, or adjustable, to adapt to the dimensions of the room where the ceiling is being installed.

Installed Sheet and New Sheet—these are relative terms used to describe the two sheets involved in each step of the installation process. An installed sheet is a sheet of drywall which has been at least partially attached to the ceiling structure. A new sheet is a drywall sheet being installed adjacent to an installed sheet. As work progresses, the new sheet will be attached to the ceiling and serve as the installed sheet relative to the next New Sheet.

Pivot—in reference to the disclosed invention, this term describes any means of attaching the leg to the main body of the apparatus which allows relative rotational movement between the body and the leg.

Support Ledge—when used in reference to the supporting ledge incorporated into the present invention, this term in intended to apply to any ledge or lip capable of supporting the edge of a sheet, without regard to the method of forming. In the disclosed embodiments, the ledge is formed as an extension to the material used to form the main body of the apparatus.

Stabilizer Ledge—that portion of the disclosed invention adjacent to, and extending away from, the alignment ledge which contacts the lower surface of the drywall sheet and prevents rotation of the apparatus around the edge of the sheet. It further provides a load bearing surface whereby the support force of the leg is distributed across an area of the sheet larger than the end of the leg.

The various drawing figures disclose the present invention in detail showing the preferred embodiment, and alternative embodiments. The following discussion is with reference to these figures.

FIG. 1 provides a perspective view of a first embodiment of the disclosed invention. This embodiment will be used in much of the subsequent description to illustrate the use of the invention. This description is also generally applicable to the alternative embodiments disclosed herein. The main body of the apparatus, 100, is formed to provide many of the essential features. The alignment ledge, 104, provides an opening facing the installed sheet. The stabilizer ledge, 102, extends outward from the alignment ledge, providing additional support for the sheet. The clearance gap, 106, provides an opening into which the edge of a new sheet can enter, allowing the apparatus to move toward the sheet. The support ledge, 108, provides support for a new sheet as it is lifted into position. Leg, 110, supports both the apparatus and the sheet during the installation process. A more detailed description of the apparatus and its method of use is presented in the following description.

It is important to note that the apparatus serves two roles during the installation process, and shifts from one to the other with no change to the apparatus. First, as a new sheet of drywall is being lifted into position, the apparatus is attached to the leading edge of the sheet. With the leg braced against the floor, the apparatus then holds the sheet in position as the sheet is fastened to the ceiling. Second, with the sheet now fastened in place, the apparatus remains in position and, stabilized by the installed sheet, provides a supporting ledge on which the trailing edge of another new sheet is placed as it is lifted into position. In use, several instances of the apparatus will be in use simultaneously, some at the trailing edge of a sheet, and some at the leading edge.

Figure 2:
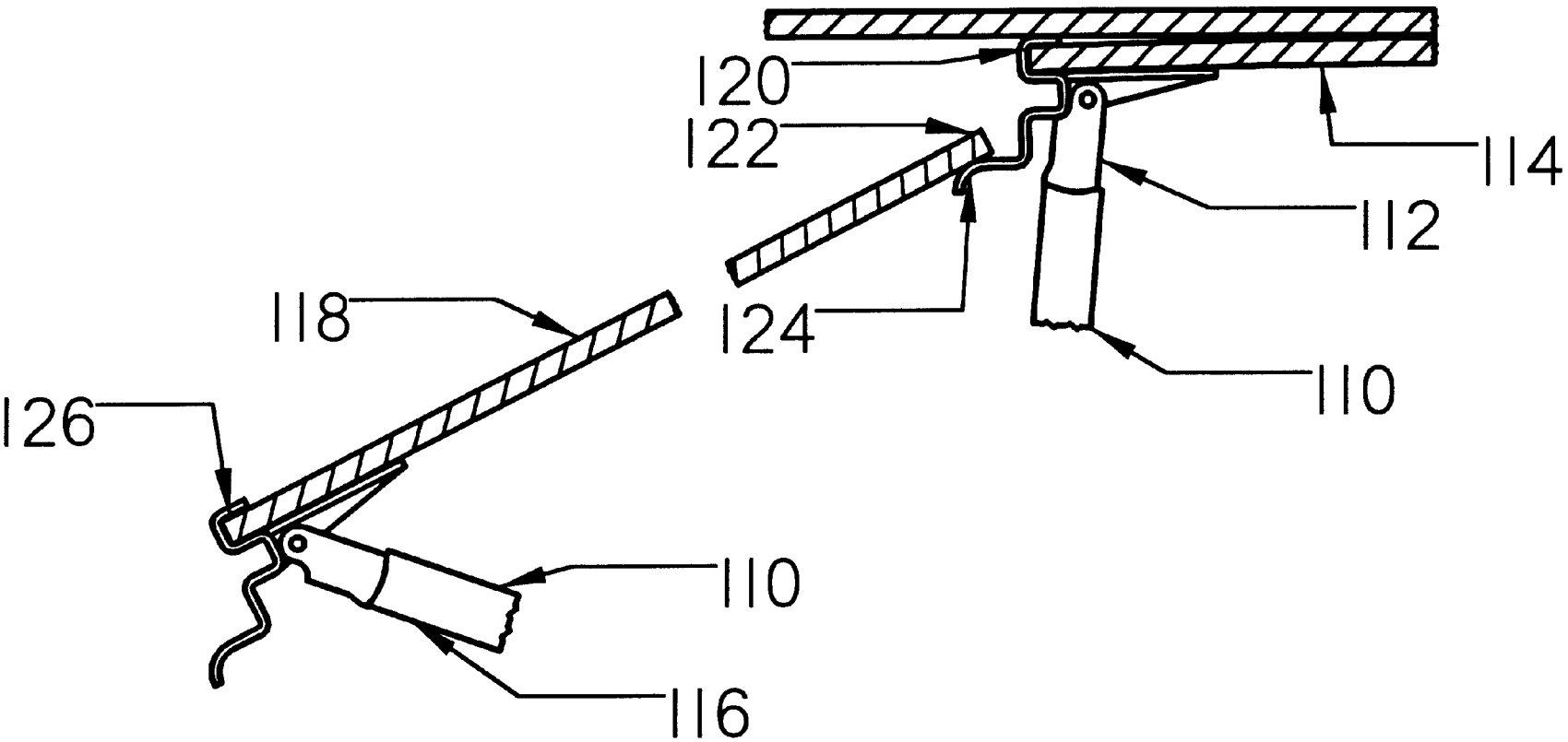
FIG. 2 is a side view of the first embodiment in use. One instance of the invention is in position on an installed sheet and supports the upper edge of a new sheet, while a second instance is attached to the lower edge of the new sheet prior to the sheet being raised into position.
Figure 20:
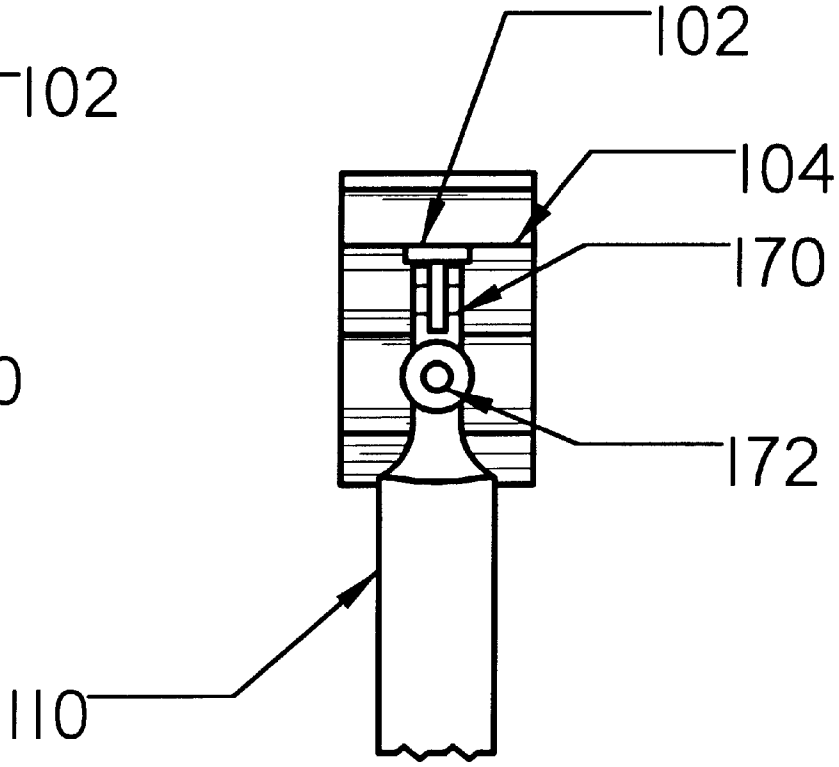
FIG. 20 provides an end view of the alternative embodiment which incorporates two axes.
Figure 19:
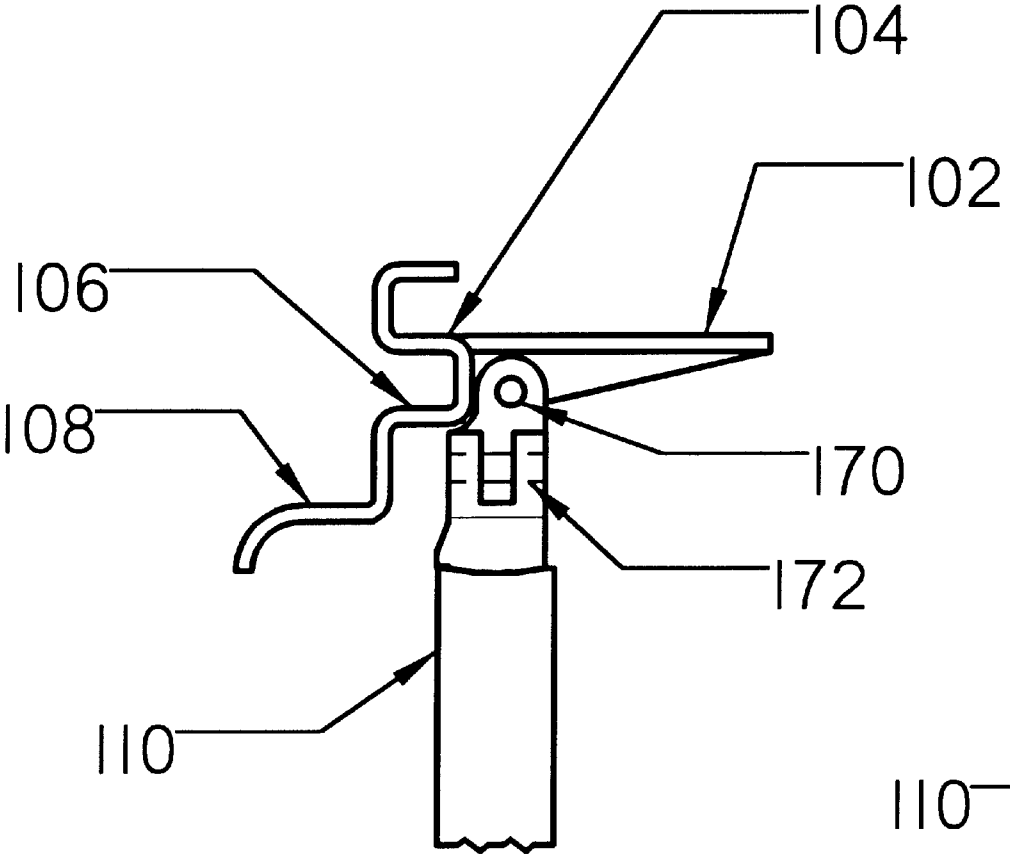
FIG. 19 provides a side view of an alternative embodiment which incorporates two axes about which the leg can pivot.

FIG. 2 illustrates the above relationship. A first instance of the apparatus, 112, is positioned at the leading edge, 120, of an installed sheet, 114, with its leg, 110, braced against the floor. The trailing edge, 122, of the new sheet, 118, rests against the support ledge, 124, of the first instance. A second instance of the apparatus, 116, is positioned at the leading edge, 126, of the new sheet in preparation for lifting the sheet into position. The leg, 110, of the second instance is pivoted under the new sheet in order to clear the floor. As the sheet is raised, the sheet will pivot at its trailing edge, 122, and as the sheet is lifted the leg of the second instance will move into position under the sheet providing support. This movement of the leg relative to the body of the apparatus can be achieved by either a simple pivot which allows movement in a single plane, or by a gimbal-like arrangement or pair of offset pivots, 170 and 172, as shown in FIGS. 19 and 20, which allows the leg to pivot about two axes for increased flexibility.

Figure 3:
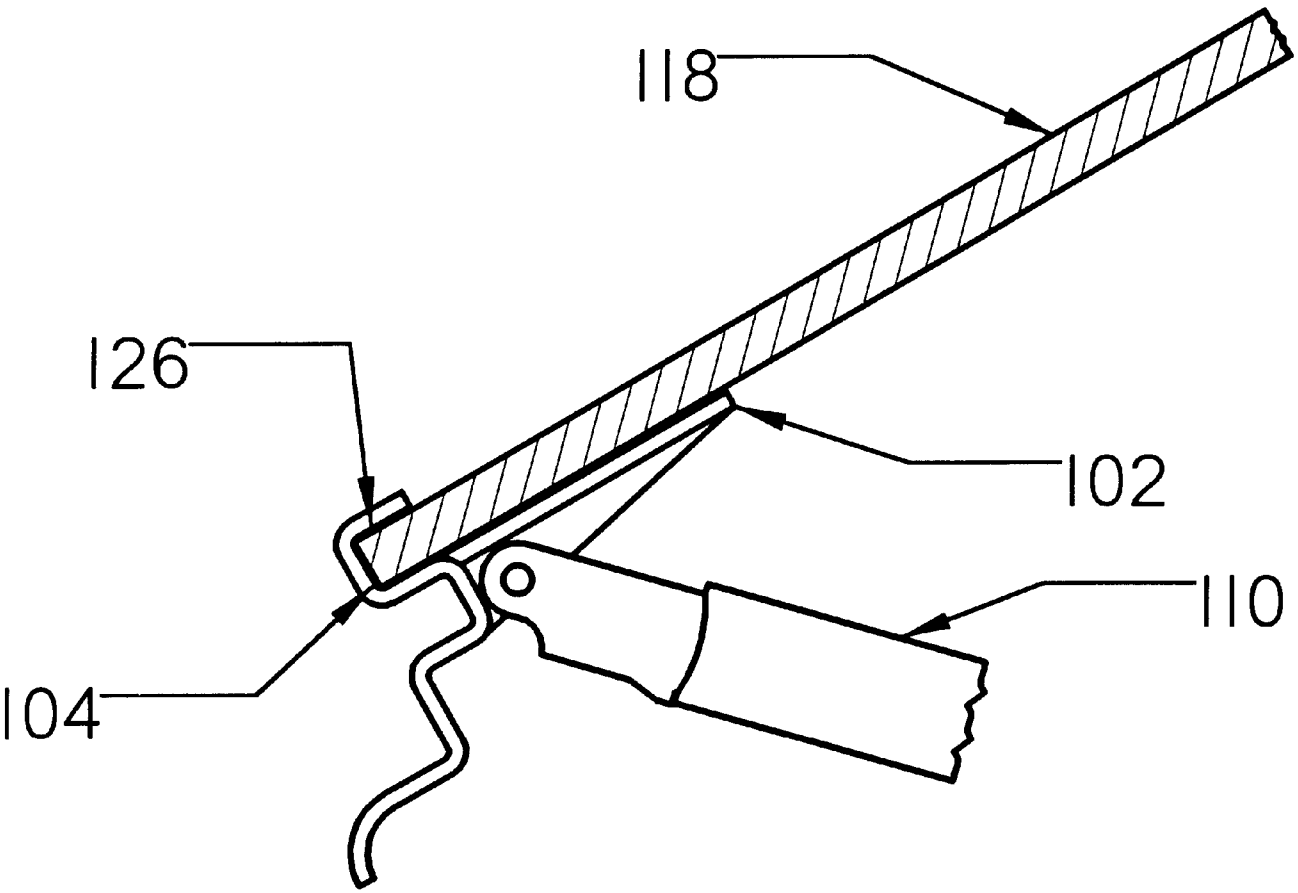
FIG. 3 is a detailed side view of the first embodiment in position at the lower edge of the new sheet.

FIG. 3 provides a detailed view of the apparatus as it is positioned at the leading edge of a new sheet, 118. The leading edge of the sheet, 126, is placed in the alignment ledge, 104, of the apparatus. The stabilizer ledge, 102, rests against the lower surface of the sheet. The combination of the alignment ledge and the stabilizer ledge prevents any movement of the apparatus relative to the sheet except linearly away from the sheet. This movement will be resisted by the lifting force applied to the apparatus as the sheet is lifted into position. The stabilizer ledge serves the further purpose of distributing the supporting force across a larger surface area of the sheet.

Figure 4:
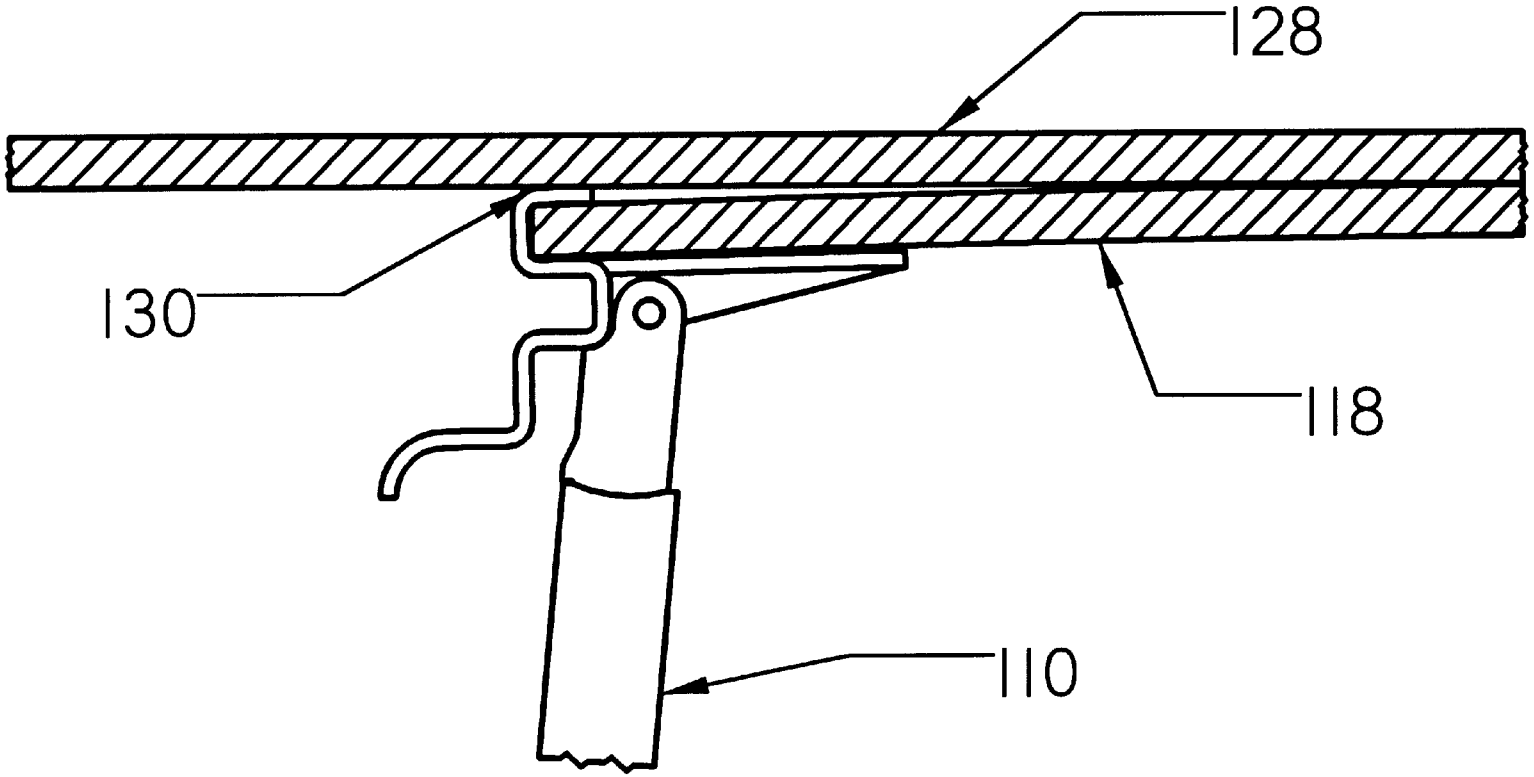
FIG. 4 is a detailed side view of the first embodiment in position holding the new sheet in position against an existing ceiling.

FIG. 4 shows the apparatus in position after the new sheet, 118, has been lifted into position. The leg, 110, is braced against the floor and holds the apparatus and the sheet in position adjacent to the ceiling structure, 128. The sheet will then be attached to the ceiling structure by whatever means are suitable, such as screws. At this point, the leading edge of the sheet will not be attached, allowing a slight gap to remain between the sheet and the ceiling, for the upper lip, 130, of the alignment ledge.

Figure 5:
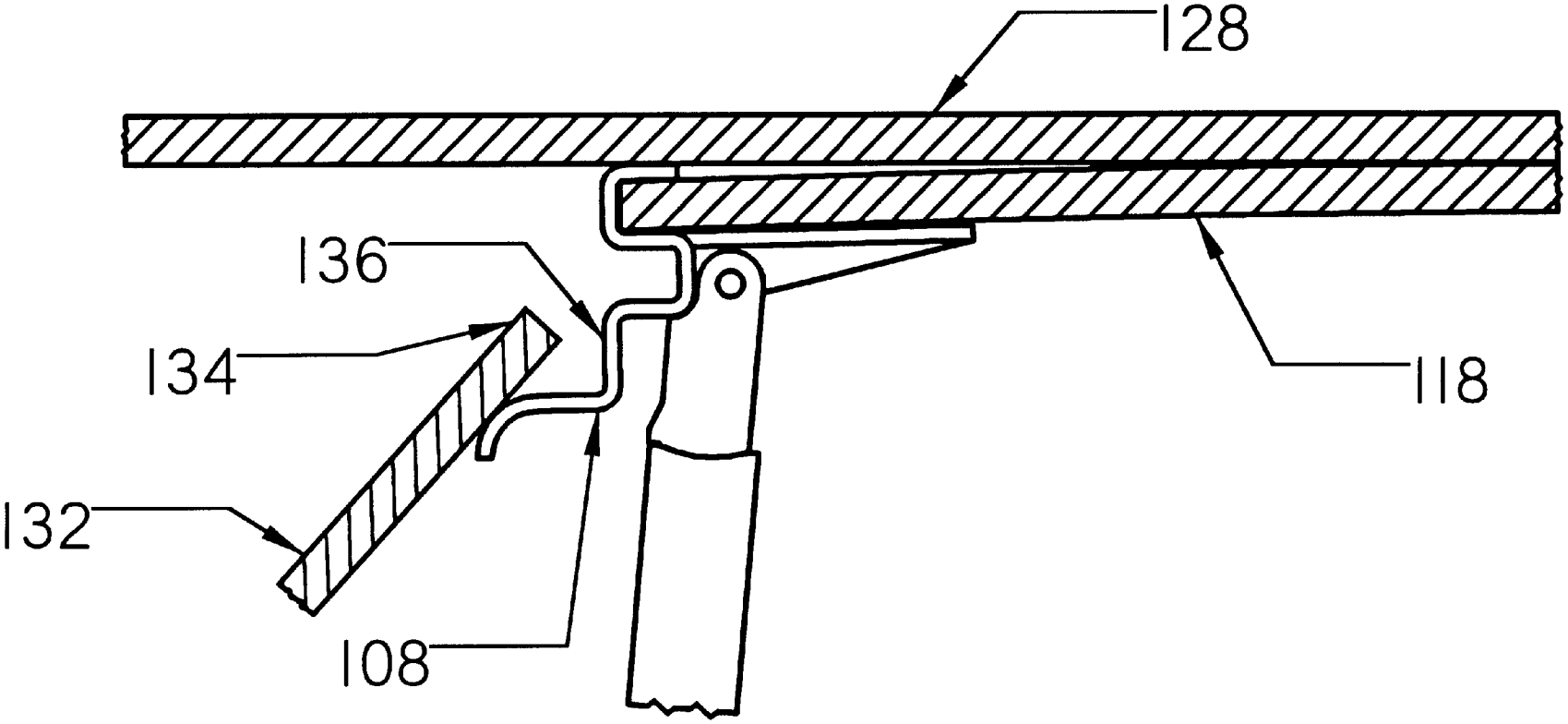
FIG. 5 is a detailed side view of the first embodiment in position on an installed sheet, after the sheet is attached, with the trailing edge of a new sheet in position on the support ledge before the new sheet is raised into position.
Figure 6:
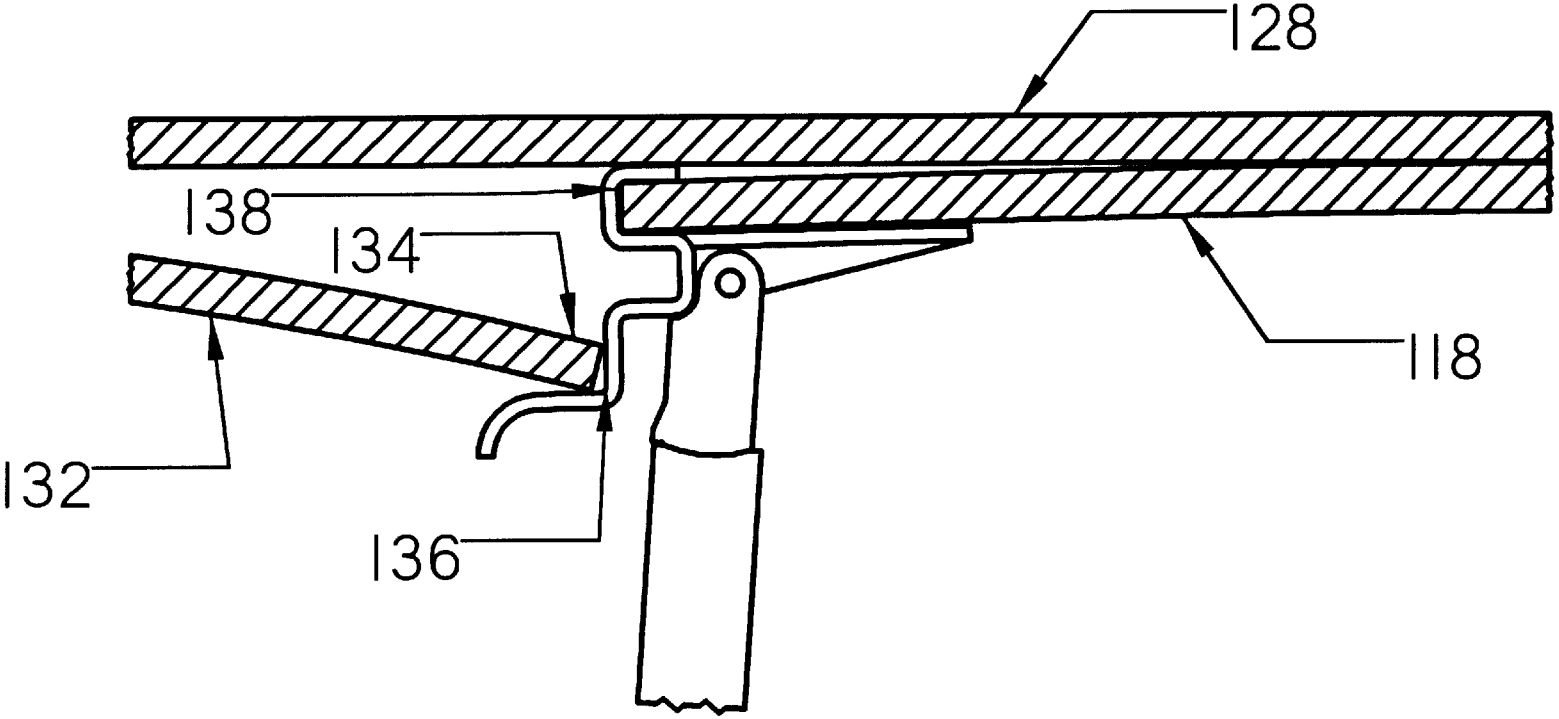
FIG. 6 is a detailed side view of the first embodiment in position on an installed sheet, with the trailing edge of a new sheet in position on the support ledge after the new sheet is raised into position.

FIG. 5 illustrates the apparatus in its second role. With the previous sheet, 118, now installed, the apparatus serves as a support for another new sheet, 132. The trailing edge, 134, of the new sheet is placed against the support ledge, 108, of the apparatus. As the sheet is raised, the sheet rotates and moves into position with the trailing edge abutting the back surface, 136, of the support ledge, as shown in FIG. 6.

The relative positioning of the back surface, 136, of the support ledge, and the back surface, 138, of the alignment ledge effect the size of the gap between the edges of the two sheets. These two surfaces are positioned relative to each other such that after the apparatus is removed, and the trailing edge lifted into position, the edges of the two sheets will align as desired. In the preferred embodiment, the two surfaces are positioned substantially in the same plane resulting in a flush fit between the edges after the apparatus is removed.

Figure 7:
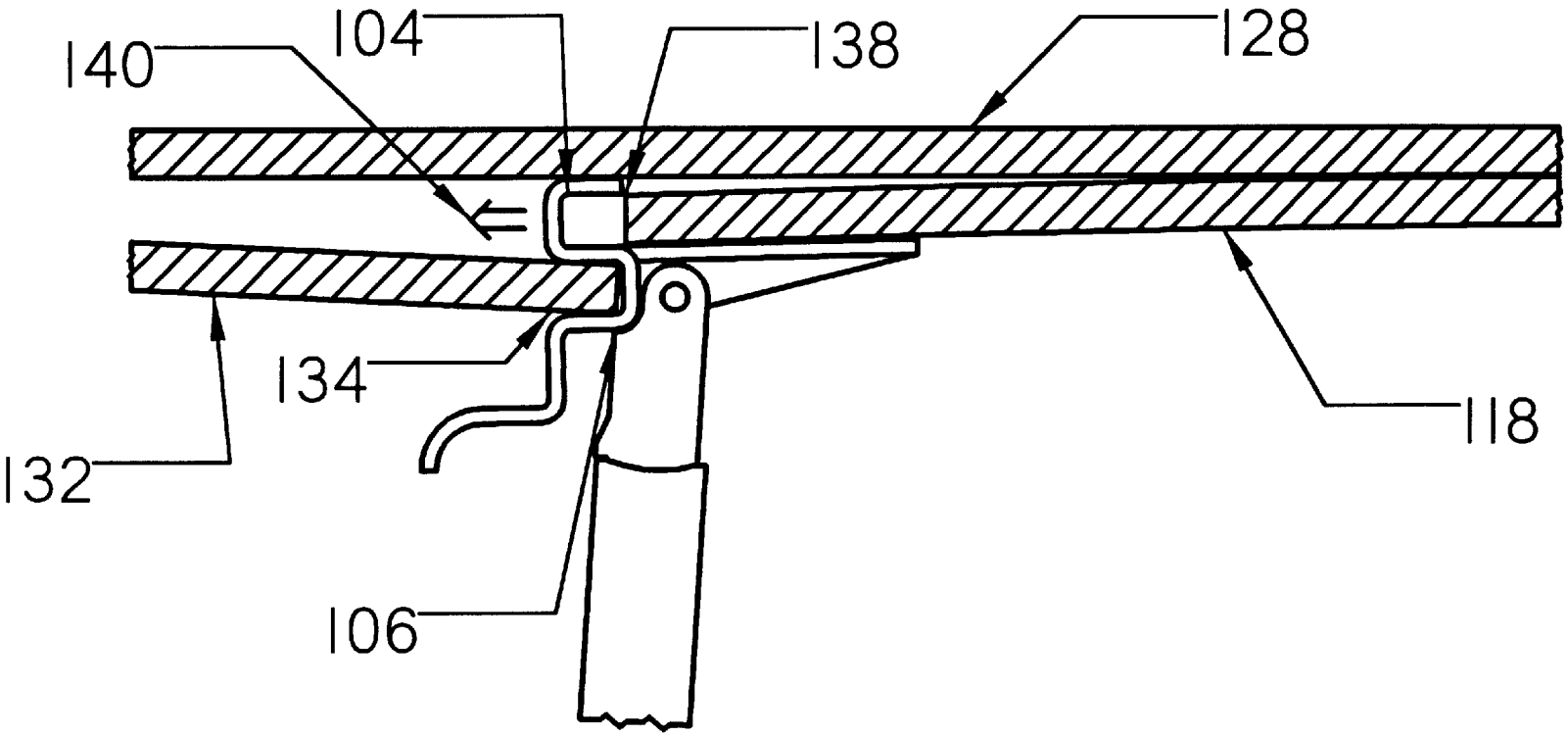
FIG. 7 is a detailed side view of the first embodiment showing the first step in removing the apparatus, where the trailing edge of the new sheet engages the clearance gap as the apparatus disengages the installed sheet.

With the sheet raised into position and supported it is then attached to the ceiling structure. As described above, the leading edge of the sheet will not be attached to provide a gap between the sheet and the ceiling. In a similar manner, the trailing edge will also be left unattached to leave a gap for the removal of the apparatus. In FIG. 7, the first step in removing the apparatus is shown. The new sheet, 132, is raised slightly to align with the clearance gap, 106. The apparatus is moved laterally, in the direction of arrow 140, so that the trailing edge, 134, of the new sheet enters the clearance gap. This movement allows the alignment ledge, 104, to disengage the leading edge, 138, of the installed sheet, 118.

Figure 8:
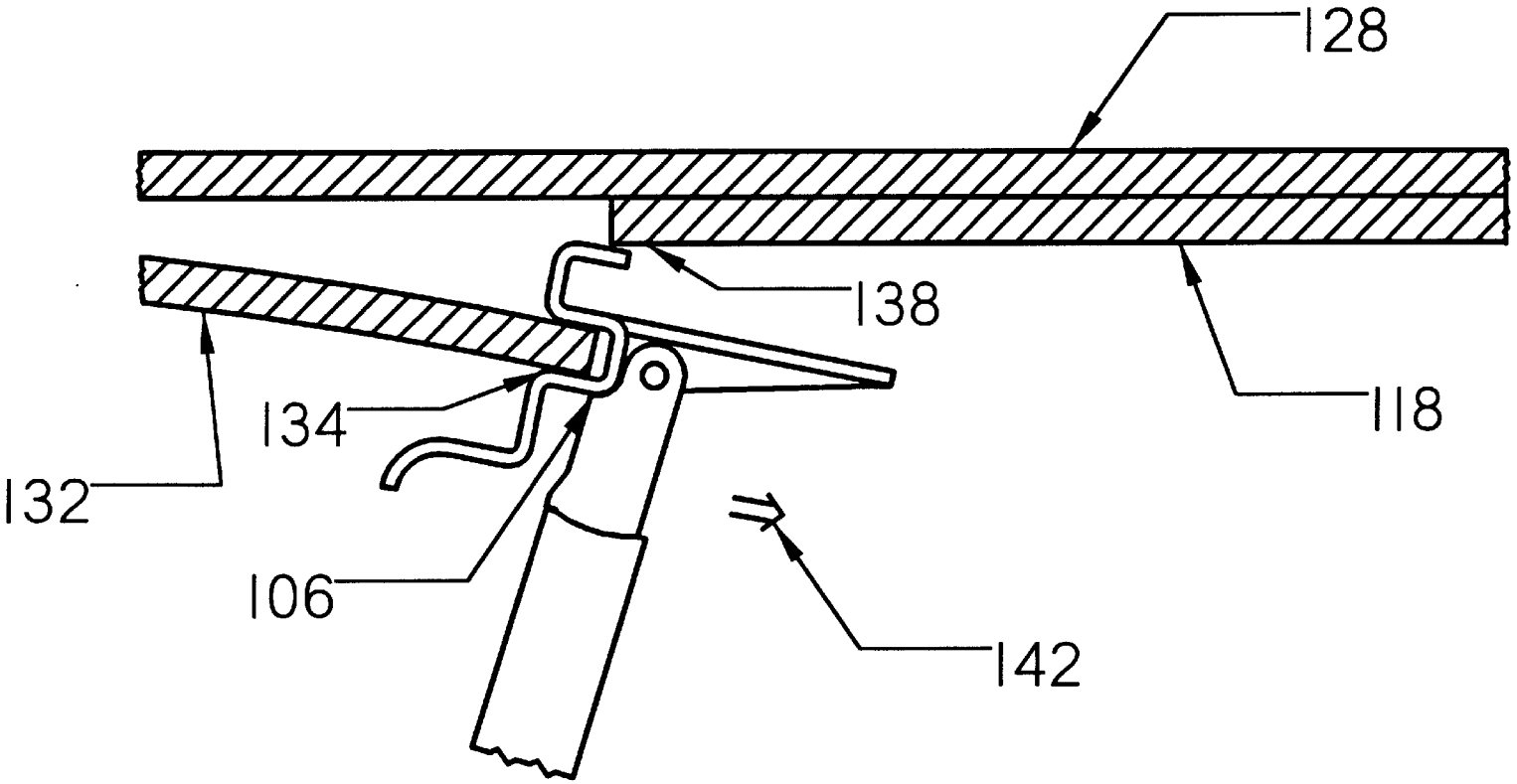
FIG. 8 is a detailed side view of the first embodiment showing the second step in removing the apparatus, where the trailing edge of the new sheet is pulled downward, along with the apparatus, allowing the apparatus to clear the lower edge of the installed sheet.

With the apparatus disengaged from the installed sheet, it can be moved downward by flexing the edge of the new sheet as shown in FIG. 8. This slight flexing of the new sheet returns the trailing edge, to approximately the same position as when it was supported by the support ledge. With the leading edge, 138, of the installed sheet, 118, freed of the alignment ledge, it can move upward slightly to become flush against the ceiling. The combined movement of the edges of the two sheets provides a sufficient gap that the apparatus can then be withdrawn, in the direction of arrow 142, disengaging the trailing edge of the new sheet from the clearance gap, 106.

Figure 9:
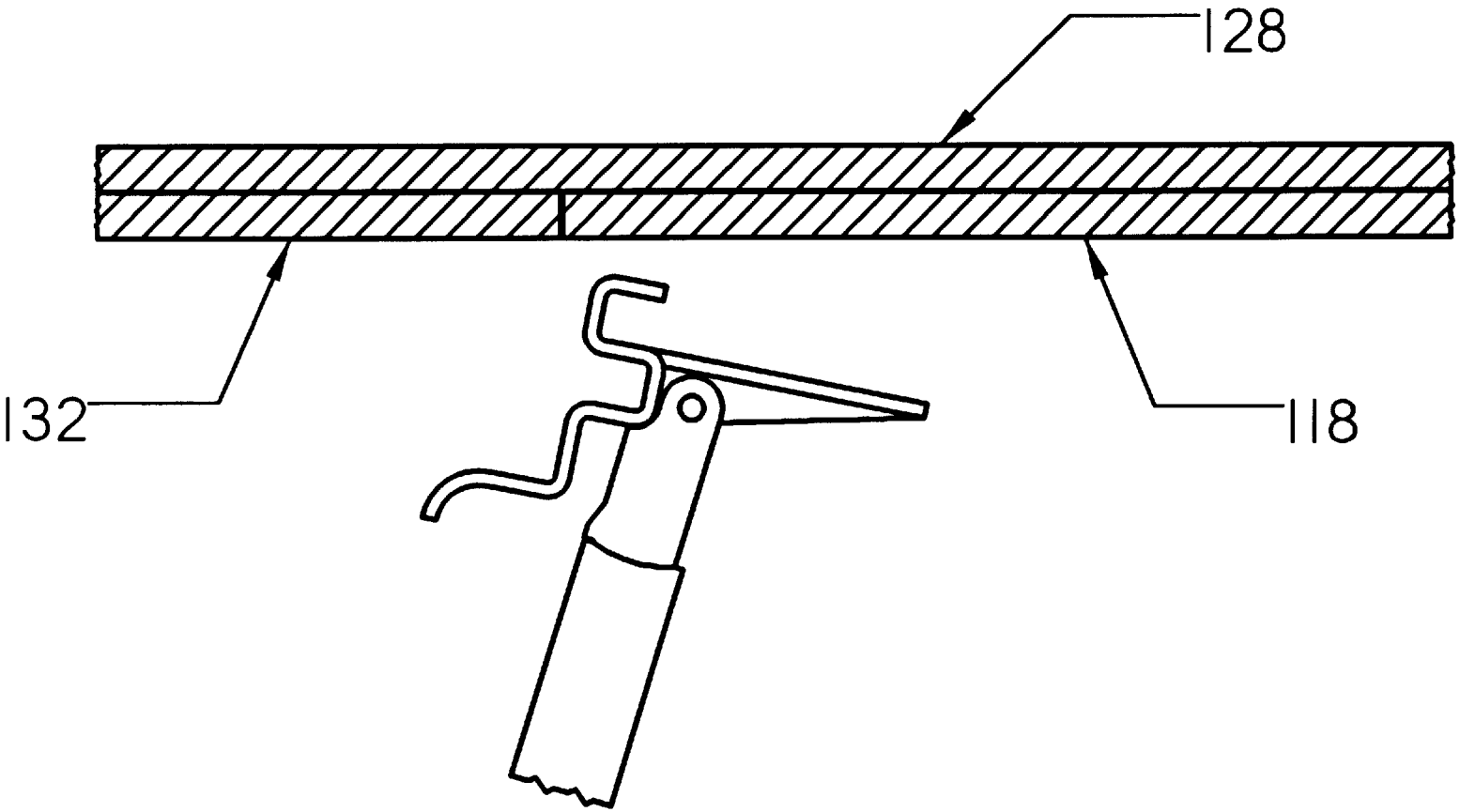
FIG. 9 is a detailed side view of the first embodiment showing the final step in removing the apparatus, where the trailing edge of the new sheet is disengaged from the clearance gap and the edge is raised into its installed position.

As FIG. 9 shows, with the apparatus removed, both the installed sheet, 118, and the new sheet, 132, can be raised to be flush against the ceiling structure, 128. At this time the leading edge of the installed sheet and the trailing edge of the new sheet can be attached to the ceiling structure. The process then repeats with the next sheet in sequence, with the new sheet, 132, now filling the role of installed sheet as yet another new sheet is installed.

Figure 10:
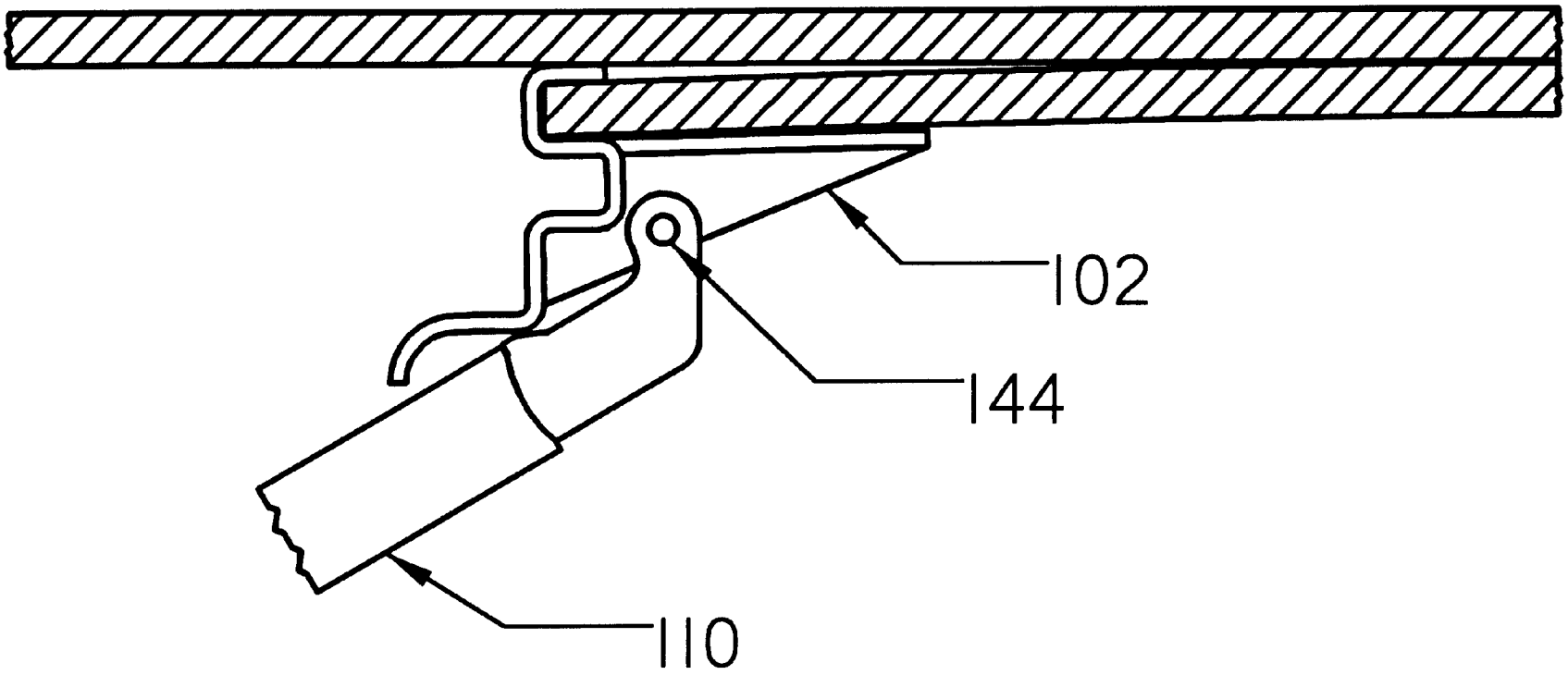
FIG. 10 is a detailed side view of a second embodiment of the disclosed apparatus which allows greater rotation of the leg toward the leading edge of the sheet.

FIG. 10 illustrates an alternative second embodiment of the disclosed invention. The pivot, 144, where the leg, 110, attaches to the stabilizer ledge, 102, has been moved downward. The shape of the leg has been modified to offset the pivot from the centerline of the leg. This combination of changes allows the leg to pivot further toward the front of the apparatus providing more flexibility in how the apparatus is used. Clearly, either of these techniques may be used alone or in combination with other alterations to achieve the same effect.

Figure 11:
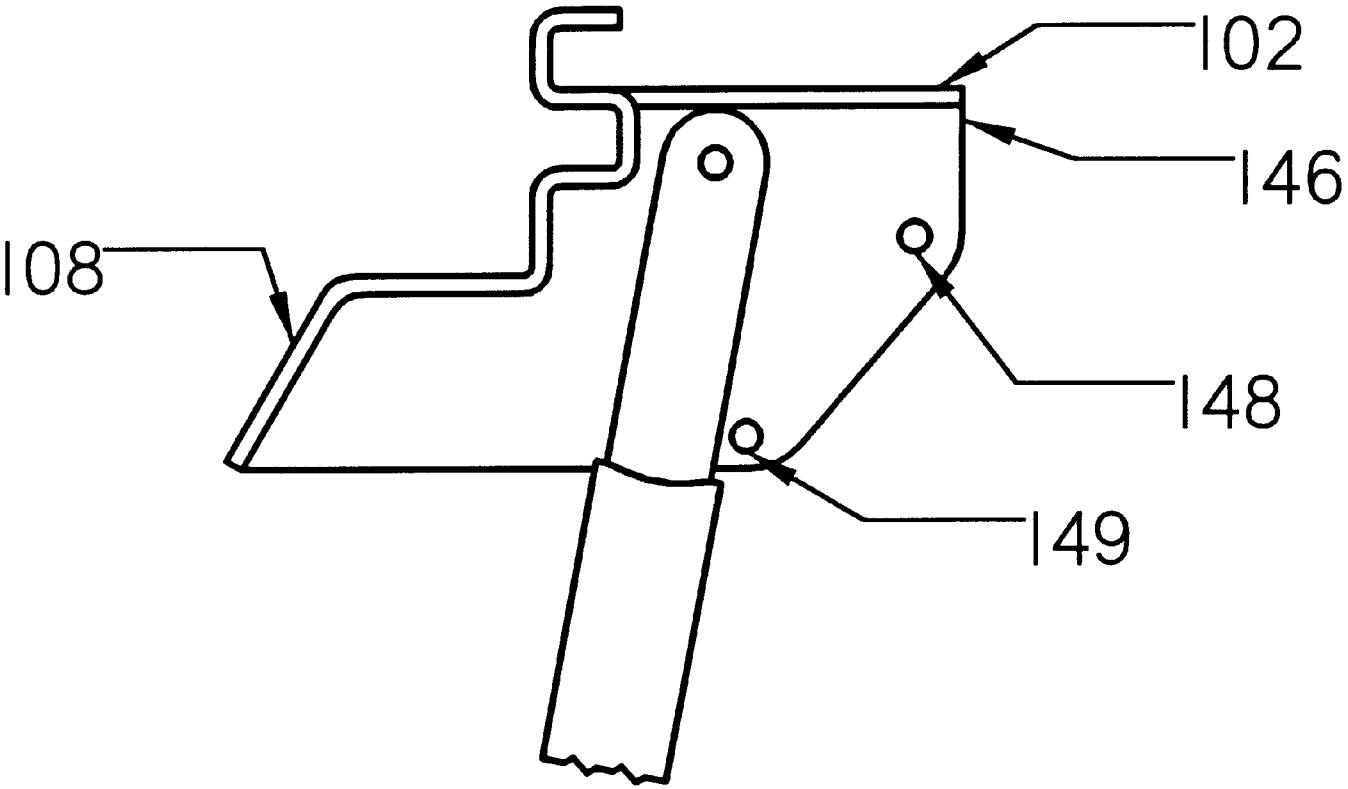
FIG. 11 is a detailed side view of a third embodiment of the disclosed apparatus showing a modified support ledge, an enlarged brace and a locking pin.
Figure 12:
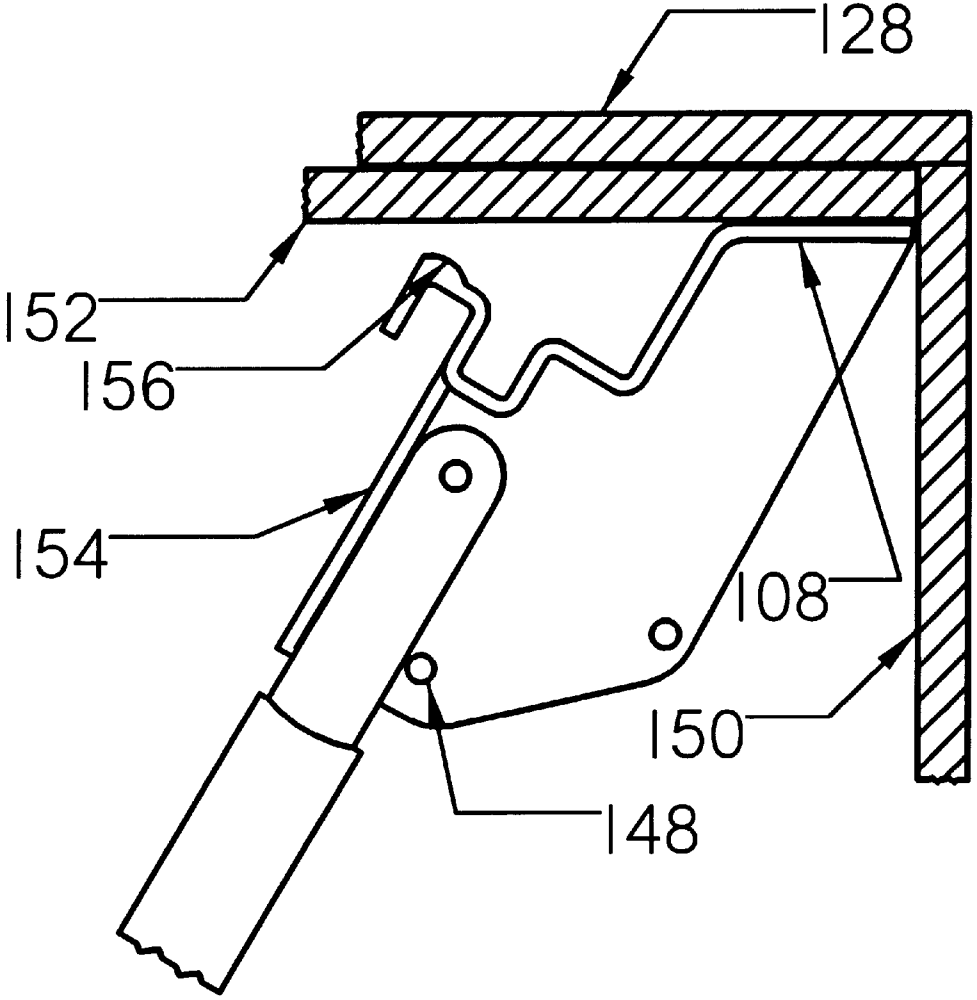
FIG. 12 is a detailed side view of the third embodiment in position holding the trailing edge of a new sheet in position at the juncture of an existing ceiling and existing wall. The locking pin is holding the leg in a fixed rotational position relative to the stabilizer ledge.

FIGS. 11 and 12 illustrate another alternative embodiment of the disclosed invention. The first embodiment, described above, is minimally useful in supporting the trailing edge of a sheet to be installed abutting a wall. This alternative embodiment addresses that problem. As shown in FIG. 11, the supporting member, 146, of the stabilizing ledge, 102, has been enlarged to extend downward further and to extend forward to brace the support ledge, 108. A locking mechanism, 148, has been added which will hold the leg in position adjacent to the stabilizing ledge. This mechanism may be a pin, a bolt, or any other suitable means for restraining the rotational movement of the leg relative to the body of the apparatus. The support ledge, 108, has been extended and flattened to provide a support surface for a sheet.

This alternative embodiment is shown in use in FIG. 12. As before, drywall sheets are being installed over an existing ceiling structure, 128. The first sheet, 152, is to be, installed abutting an existing wall, 150, or other obstacle. Ideally, this first sheet would be supported with its edge flush against the wall. In this circumstance, the alternative embodiment is utilized as shown. The main body of the apparatus, 154, has been pivoted so that the leg and the stabilizing ledge are essentially parallel. Note that parallelism is not critical to the performance of the apparatus, but is merely a convenient orientation. The locking mechanism, 148, is engaged, preventing any significant rotational movement between the leg and the main body. The angled portion of the support ledge, 108, is placed against the trailing edge of the sheet being installed and the leg is braced against the floor, thereby supporting the sheet flush against both the existing ceiling, 128, and the wall, 150. The extension of the support ledge, discussed above, provides clearance between the sheet and the comer, 156, of body of the apparatus. If desired, the dimensions and angle of the support ledge could be adjusted so that the corner, 156, also makes contact with the sheet, providing further support. This alternative embodiment also functions as described above for the first embodiment.

Figure 13:
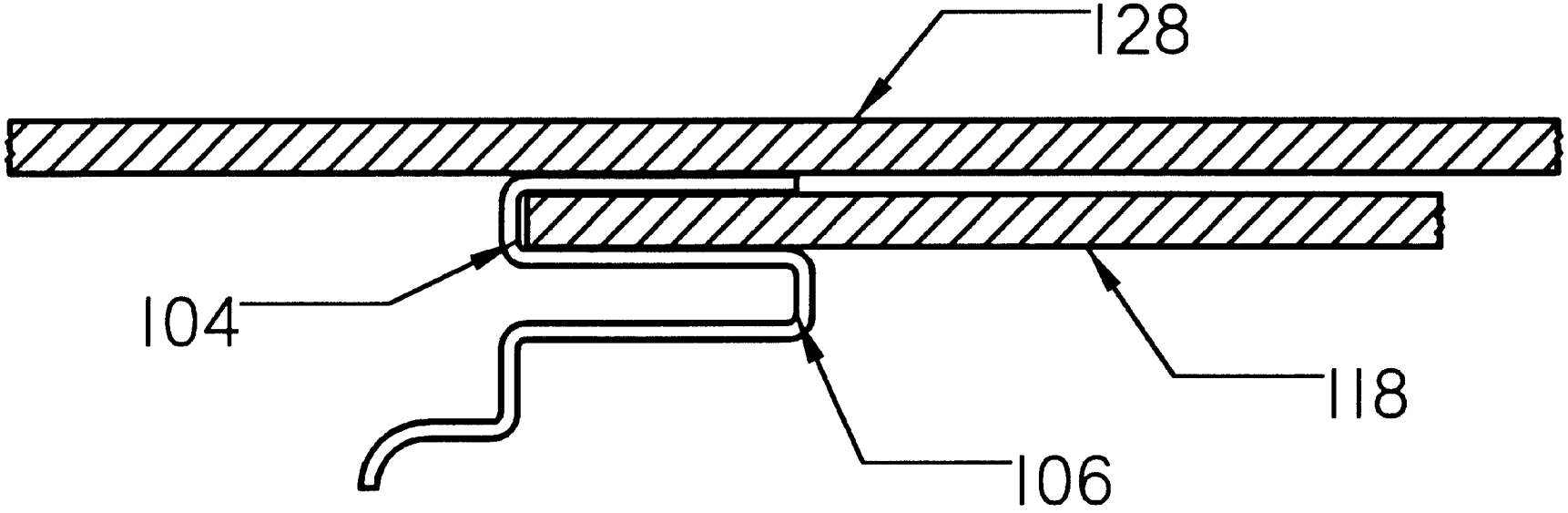
FIG. 13 is a detailed side view of a fourth embodiment of the disclosed apparatus showing an elongated clearance gap and an elongated alignment ledge, with no stabilizer ledge or leg.

FIG. 13 illustrates a further alternative embodiment of the disclosed invention. By eliminating the leg and the stabilizing ledge, the device is simplified and lightened. By extending the depth of the alignment ledge, 104, and the clearance gap, 106, and possibly widening the apparatus, the entire weight of the new sheet will be borne by the installed sheet, 118. It is used in essentially the same manner as described above for the first embodiment. This embodiment is inferior in terms of strength, especially as it is likely to flex at the rear of the clearance gap. It is also possible that the installed sheet would break under the weight of the new sheet. However, the embodiment may be adequate for use with smaller, thinner drywall sheets. Additional bracing, increased thickness, or an alternative material may provide sufficient additional rigidity to make this embodiment more viable.

Figure 14:
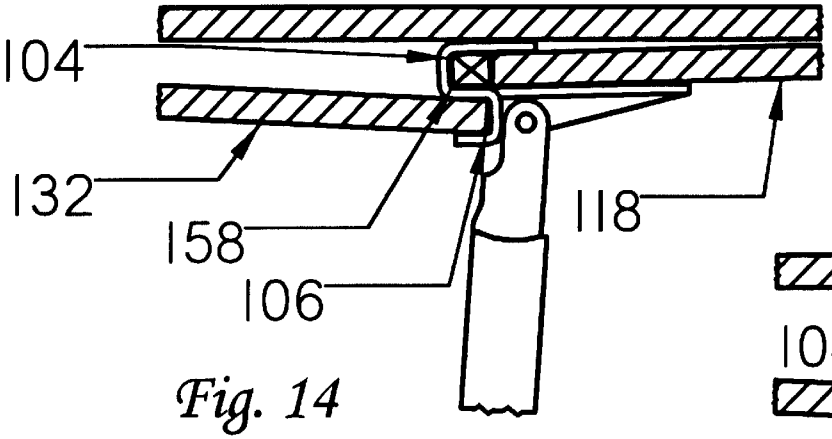
FIG. 14 is a detailed side view of a fifth embodiment of the disclosed apparatus showing an elongated alignment ledge, no support ledge, and a spacer preventing the sheet from fully entering the alignment ledge.
Figure 15:
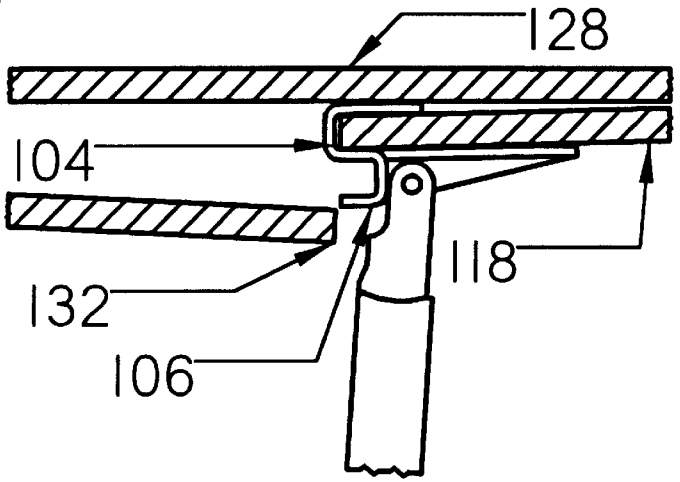
FIG. 15 is a detailed side view of the fourth embodiment of the disclosed apparatus showing the spacer removed, allowing the sheet to fully enter the alignment ledge, causing the trailing edge of the new sheet to disengage the clearance gap.
Figure 16:
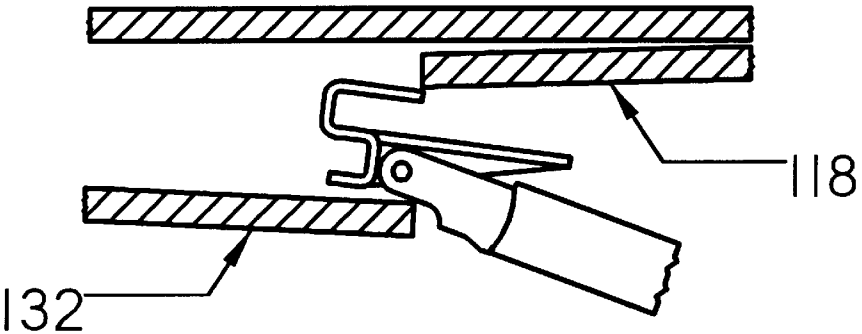
FIG. 16 is a detailed side view of the fourth embodiment of the disclosed apparatus showing the apparatus being removed by lowering the trailing edge of the new sheet allowing the apparatus to be disengaged from the installed sheet.

FIGS. 14 through 16 illustrate yet another alternative embodiment of the disclosed invention. In this embodiment, the support ledge, 108, has been eliminated and its function assumed by the clearance gap, 106. A spacer, 158, is placed in the alignment ledge, 104, to prevent the installed sheet from fully entering the alignment ledge. The spacer is sized so that the leading edge of the installed sheet is substantially aligned with the trailing edge of the new sheet. Installation of the new sheet proceeds as above, except that the trailing edge of the new sheet is placed directly into the clearance gap. Removal of the apparatus is achieved as shown in FIGS. 15 and 16. The spacer, 158, is removed, allowing the leading edge of the installed sheet to fully enter the alignment ledge. This allows the apparatus to move away from the new sheet, disengaging the clearance gap from the new sheet. The new sheet is flexed downward, and removal proceeds as described for the first embodiment.

It may be possible to combine the features of the embodiments shown in FIG. 13 and FIGS. 14 through 16 to provide yet another embodiment similar to the latter, but with no leg.

Figure 17:
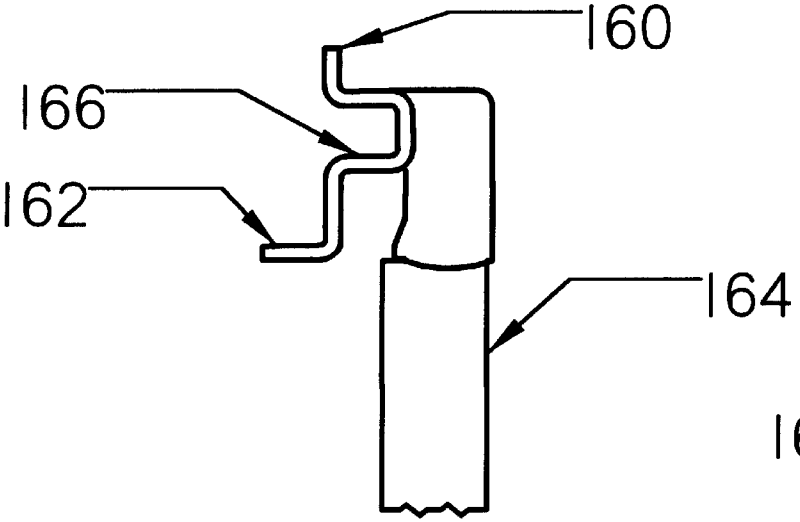
FIG. 17 is a detailed side view of a fifth embodiment of the invention showing a minimal configuration comprising an L-shaped alignment ledge, a clearance gap, a noncurved support ledge, and an non-pivoting leg.

FIG. 17 shows a minimal configuration of the invention consisting of an L-shaped alignment ledge, 160, a clearance gap, 166, a support ledge, 162, and a non-pivoting leg, 164.

Figure 18:
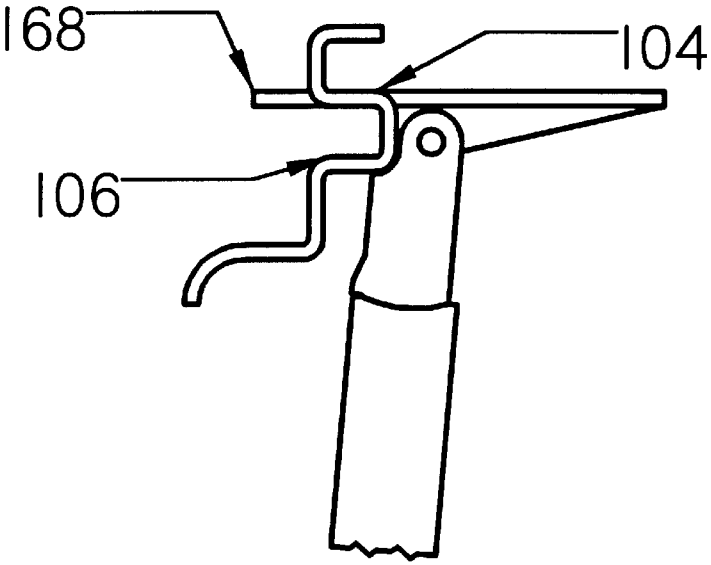
FIG. 18 is a detailed side view of a sixth embodiment showing the addition of shelf 168.

FIG. 18 shows an alternative embodiment of the invention. Shelf 168 has been added, extending outward from the top of the clearance gap. In use, this allows the trailing edge of the sheet to be lifted off of the support shelf and manually adjusted to better align with the leading edge of the installed sheet. One situation where this would be desirable is where the ceiling is slightly off-square and the sheets need to be adjusted accordingly. Shelf 168 simplifies this operation by maintaining alignment between the trailing edge of the sheet and the clearance gap as the sheet is moved.

While the preferred form of the invention and some alternative embodiments, have been disclosed above, further alternative methods of practicing the invention are readily apparent to the skilled practitioner. The above description of the preferred embodiment is intended to be illustrative only and not to limit the scope of the invention.

What is claimed is:

1. An apparatus for installing drywall in an overhead position, which does not require access to the ceiling joists, comprising:

(a) a main body having a clearance gap;

(b) an alignment ledge, connected to said main body and positioned above said clearance gap, having a rear face and being substantially C-shaped whereby it can enclose the edge of a drywall sheet on three sides;

(c) a support ledge, connected to said main body, and below said clearance gap, and having a rear face; and (d) means for attaching a support leg to said main body;

wherein said rear face of said alignment ledge faces the opposite direction of, and is in substantially the same plane as, said rear face of said support ledge.

2. An apparatus for installing drywall in an overhead position, which does not require access to the ceiling joists, comprising:

(a) a main body having a clearance gap;

(b) an alignment ledge, substantially C-shaped whereby it can enclose the edge of a drywall sheet on three sides, connected to said main body and positioned above said clearance gap;

(c) a support ledge, comprising a downwardly curved section, connected to said main body, and below said clearance gap; and (d) means for attaching a support leg to said main body.

3. The drywall installing apparatus of claim 1 wherein said means for attaching allows relative rotational movement between said body and the support leg about two axes, said axes disposed at an angle of at least 10 degrees to the longitudinal axis of the support leg when the leg is positioned to support said apparatus.

4. The drywall installing apparatus of claim 1 further comprising a shelf extending outward from and parallel to the upper edge of said clearance gap.

5. An apparatus for installing drywall in an overhead position, which does not require access to the ceiling joists, comprising:

(a) a main body having a clearance gap;

(b) an alignment ledge, substantially C-shaped whereby it can enclose the edge of a drywall sheet on three sides, connected to said main body and positioned above said clearance gap;

(c) a stabilizing ledge extending substantially perpendicular to said main body and in substantially the same plane as the lower surface of said alignment ledge;

(d) a support ledge, connected to said main body, and below said clearance gap; and (e) means for attaching a support leg to said main body.

6. The drywall installing apparatus of claim 5 wherein said means for attaching allows relative rotational movement between said body and the support leg about one axis.

7. The drywall installing apparatus of claim 5 wherein said support ledge comprises a downwardly curved section.

8. The drywall installing apparatus of claim 6 further comprising a support surface attached at an angle to said support ledge and a means for locking said means for attaching and said main body in substantially fixed relative rotational position; whereby said support surface is adapted to support the drywall sheet adjacent to an existing wall.

9. The drywall installing apparatus of claim 8 further comprising a second locking means for preventing the rotational movement of said main body about said means for attaching in the direction of said stabilizing ledge rotating towards the floor.

* * * * *